US006959463B2

(12) United States Patent
Macari

(10) Patent No.: US 6,959,463 B2
(45) Date of Patent: Nov. 1, 2005

(54) BED GUARD ASSEMBLY

(75) Inventor: Jason Macari, Lincoln, RI (US)

(73) Assignee: Summer Infant, Inc., Lincoln, RI (US)

( * ) Notice: Subject to any disclaimer, the term of this patent is extended or adjusted under 35 U.S.C. 154(b) by 0 days.

(21) Appl. No.: 10/755,704

(22) Filed: Jan. 12, 2004

(65) Prior Publication Data

US 2004/0154100 A1 Aug. 12, 2004

Related U.S. Application Data

(63) Continuation-in-part of application No. 10/285,331, filed on Oct. 31, 2002, now Pat. No. 6,725,476.
(60) Provisional application No. 60/411,307, filed on Sep. 17, 2002.

(51) Int. Cl.[7] ..... A47C 21/08
(52) U.S. Cl. ..... 5/425; 5/426; 5/428; 5/430
(58) Field of Search ..... 5/425, 426, 428, 5/430, 659, 662

(56) References Cited

U.S. PATENT DOCUMENTS

| | | | | |
|---|---|---|---|---|
| 2,751,608 A | * | 6/1956 | Lucas | 5/426 |
| 3,289,223 A | | 12/1966 | Oja et al. | |
| 3,290,701 A | | 12/1966 | Luff | |
| 3,474,473 A | | 10/1969 | Hannaberg | |
| 4,178,645 A | | 12/1979 | Cosme | |
| 4,833,743 A | | 5/1989 | Howell et al. | |
| 5,038,430 A | * | 8/1991 | Bly | 5/425 |
| 5,437,067 A | | 8/1995 | Bernstein et al. | |
| 5,463,784 A | | 11/1995 | Alpern | |
| 5,519,905 A | | 5/1996 | Bernstein et al. | |
| 5,577,277 A | | 11/1996 | Sundberg et al. | |
| 5,596,776 A | | 1/1997 | Huang | |
| 5,640,726 A | | 6/1997 | Fichner-Rathus | |
| 6,134,731 A | | 10/2000 | Thom et al. | |
| 6,453,490 B1 | | 9/2002 | Cardinale | |
| 6,725,476 B2 | * | 4/2004 | Macari | 5/426 |
| 6,728,981 B1 | * | 5/2004 | Gutierrez | 5/414 |

FOREIGN PATENT DOCUMENTS

| | | |
|---|---|---|
| GB | 2070921 A | 9/1981 |
| GB | 2225716 A | 6/1990 |

* cited by examiner

*Primary Examiner*—Michael Trettel
(74) *Attorney, Agent, or Firm*—IP Strategies

(57) ABSTRACT

A bed guard assembly includes a number of end panels, flexible connecting material for placement beneath a mattress, and connection pieces. The connection pieces connect the flexible connecting material to the end panels such that at least one end panel opposes another end panel when the flexible connecting material is disposed beneath a mattress. The end panel includes a rigid frame, a substantially horizontal rigid segment spanning an interior of the outer frame, and a fabric cover. The connection pieces are adjustable, and include a mechanism for pulling taut the connecting material.

62 Claims, 7 Drawing Sheets

BED GUARD ASSEMBLY

CROSS-REFERENCE TO RELATED APPLICATIONS

This is a continuation-in-part of U.S. patent application Ser. No. 10/285,331, which was filed on Oct. 31, 2002, now U.S. Pat. No. 6,725,476, and which in turn was based on U.S. Provisional Patent Application Ser. No. 60/411,307, which was filed on Sep. 17, 2002.

BACKGROUND OF THE INVENTION

The present invention relates to guard assemblies for beds, used to prevent an occupant of the bed from falling off the bed.

Bed guard assemblies, such as side rails, are well known. These assemblies are useful in several applications. For example, small children making the transition from sleeping in an enclosed crib to sleeping on an open bed often need a barrier to prevent a fall onto the floor while sleeping. Use of such barriers on the top bunk of a set of bunk beds also prevents a child from inadvertently falling during the night. Often, bed-ridden adults, such as hospital patients, require such a barrier also. Beds on moving platforms, such as trains and ships, often use such restraints, as do beds on submarines and in other environments in which tight quarters require a narrow sleeping space. Conventionally, these rails are placed on the sides of the bed only, but can also be placed at the head and foot of the bed, if the frame and headboard do not provide a sufficient barrier.

Conventional bed guard assemblies provide the obstruction needed for any of these applications, but usually have one or more disadvantages. For example, many systems can be large and bulky, making assembly and disassembly difficult, and storage impractical. These systems are usually disposed under the mattress or attached directly to the bed using means that are similarly complicated and unwieldy. Simpler systems have been devised, but these tend not to be as sturdy or durable. Others provide hard, heavy impediments that could actually hurt a child when bumped, and over time might also damage the bed. What is needed is a secure bed guard that is easy to attach to and detach from the bed, that is compact for storage, and that provides a safe barrier for a child.

BRIEF SUMMARY OF THE INVENTION

The present invention is a bed guard apparatus that attaches to a bed and provides a secure barrier against falling out of the bed. The apparatus includes opposing panels that act as the barriers, and which are connected together, for example, below the mattress. The connection system is adjustable to adapt to any size bed, and provides for quick and easy implementation. When not in use, the apparatus is compact and easy to store.

Thus, according to one aspect of the present invention, a bed guard assembly includes a number (for example, two) of end panels, flexible connecting material for placement beneath a mattress, and connection pieces. The connection pieces connect the flexible connecting material to the end panels such that at least one end panel opposes another end panel when the flexible connecting material is disposed beneath a mattress.

The flexible connecting material can include strips of webbing, which in turn can include a first strip of webbing connected to first ends of the end panels, and a second strip of webbing connected to second ends of the end panels. The strips of webbing can be made of, for example, a material including nylon.

The end panels can include a rigid outer frame, which can be made of metal, such as steel, and a substantially horizontal rigid segment spanning an interior of the outer frame. The rigid outer frame can be made from removably connected rigid tubes, which can have ends with different cross-sectional diameters, so that each rigid tube can be fitted to adjacent rigid tubes by sliding attachment of a larger diameter end over a smaller diameter end. The rigid outer frame can be constructed from a number of components, such as a top member, two side members, and two corner members attaching respective side members to opposite ends of the top member. Alternatively, the rigid outer frame can include substantially parallel opposing top and bottom portions connected to substantially parallel opposing side portions, and can have rounded corners at connections of the top portion with the side portions. In any case, the rigid outer frame can include a number of segments that are removably attached to each other.

According to such an embodiment, the substantially horizontal rigid segment can be coupled to the substantially parallel opposing side portions. For example, the substantially horizontal rigid segment can be slidably coupled to the substantially parallel opposing side portions. Also, the assembly can include fasteners that fix a position of the substantially horizontal rigid segment with respect to the substantially parallel opposing side portions. For adjustability, the assembly can include a plurality of fasteners, selected ones of which fix the substantially horizontal rigid segment at a selected position with respect to the substantially parallel opposing side portions, corresponding to the selected ones of the fasteners.

Alternatively, the assembly can include first fastener portions coupled to the substantially parallel opposing side portions, and second fastener portions, coupled to the substantially horizontal rigid segment. The second fastener portions mate with corresponding ones of the first fastener portions to fix a position of the substantially horizontal rigid segment with respect to the substantially parallel opposing side portions.

As another alternative, the assembly can include fasteners coupled to the substantially parallel opposing side portions. The substantially horizontal rigid segment can include apertures that mate with corresponding ones of the fasteners to fix a position of the substantially horizontal rigid segment with respect to the substantially parallel opposing side portions.

The substantially horizontal rigid segment can include a tubular horizontal portion having first and second end portions that couple with the substantially parallel opposing side portions. The tubular horizontal portion can include a plurality of slidably attached tubular segments. The first and second end portions can be substantially vertically-oriented tubes that slide over the respective substantially parallel opposing side portions. The assembly can include fasteners coupled to the substantially parallel opposing side portions, and the first and second end portions can include apertures that communicate with the fasteners to fix a position of the substantially horizontal rigid segment with respect to the substantially parallel opposing side portions. For adjustability, the first and second end portions can include a plurality of apertures, including selected ones that communicate with the fasteners to fix the substantially horizontal rigid segment at a position with respect to the substantially parallel opposing side portions corresponding to the selected ones of the plurality of apertures. The substantially parallel opposing side portions can include apertures through which the fasteners communicate with the apertures in the first and second end portions. Each fastener can include a spring portion and a button. The spring portion provides a bias that pushes the button through a respective one of the apertures in the substantially parallel opposing side portions and a respective one of the apertures in the first and second end portions to fix a position of the substantially horizontal rigid segment with respect to the substantially parallel opposing side portions. Such a fastener can be, for example, a Valco® snap button.

According to another exemplary embodiment, the rigid outer frame can include a top portion and first and second side portions, and at least one extension that extends at a substantially right angle to a plane defined by the top portion and the first and second side portions. For example, the frame can include a first extension attached to the first side portion, and a second extension attached to the second side portion, or a single extension attached to the frame at both side portions. The extension(s) can include a plurality of connected segments, which can be arranged to define a plane that is substantially perpendicular to a plane defined by the top portion and the first and second side portions. For example, the extension(s) can include three segments that can be connected to form three sides of a rectangle. One of the segments can be connected to the first side portion of the rigid outer frame to form the extension. If there is only one extension, a second segment can be connected to the second side portion of the rigid outer frame. In any case, the extension(s) provide a base that allows the end panel to stand upright.

The end panel can include a fabric portion framed by the rigid outer frame. The fabric portion can include netting, which in turn can include mesh material having openings of between about 0.25 inches and about 2 inches. The fabric portion can include at least one stabilizing strap spanning the fabric portion. The stabilizing strap(s) can be made of nylon. The fabric portion can include a nylon border on an outer periphery, and at least one stabilizing strap can be attached to the netting and to the nylon border. For example, at least one stabilizing strap can be attached to the netting and to the nylon border at top and bottom ends of the fabric portion. Alternatively, at least one stabilizing strap can be attached to the netting and to top and bottom portions of the rigid outer frame. The nylon border can include a sleeve that accepts components of the rigid outer frame.

The fabric portion can be removably attached to the rigid outer frame, such as by fitting the fabric portion over the rigid outer frame, including over the substantially horizontal rigid segment. In this case, the fabric portion can include a stretch material that provides a tension fit with the rigid outer frame. Alternatively, the rigid outer frame can include a first fastening implement, the fabric portion can include a second fastening implement, and the first and second fastening implements can cooperate to removably attach the fabric portion to the rigid outer frame. As another alternative, the fabric portion can include both first and second fastening implements that cooperate to removably attach the fabric portion to the rigid outer frame. In any case, the fastening implements can be, for example, snaps, or hook and loop fasteners such as Velcro®.

The connection pieces can be rigid structures, and each connection piece can be constructed to form a substantially right angle with the respective connected end panel. The connection pieces can be removably attached to the end panels and to the connecting material. For example, the connection pieces can be attached to the end panels by a connection mechanism. The connection pieces can include a rigid footing attached to the connecting material.

Alternatively, the connection pieces can include a first end connected to the connecting material and a second end connected to the end panels, and an angled joint between the first and second ends. The first end can be removably attached to the connecting material and the second end can be removably attached to the end panels. The angled joint can be adjustable, and can have a number of fixed stops. For example, the adjustable angled joint can have a stop fixed at a substantially right angle. Further, the adjustable angled joint can have a range of adjustability that allows the first end to be folded against the end panel.

The connection pieces can include an adjustment mechanism, such as a mechanism for decreasing the length of connecting material disposed between the end panels, a mechanism for reducing an amount of slack of connecting material disposed between the end panels when the end panels are disposed in fixed positions, or a mechanism for reducing an amount of slack of connecting material disposed between the end panels when the connecting material is disposed beneath the mattress and the end panels are placed against opposite sides of the mattress. For example, the mechanism can be a buckle. Alternatively, the mechanism can include a strap tensioner in communication with the connecting material, which provides releasable attachment of the mechanism with the connection material. The mechanism can further include a ratchet device in communication with the strap tensioner, which controls travel of the connecting material with respect to the mechanism, and a trigger device that actuates the ratchet device.

As an alternative, the connection pieces can include a mounting plate that is removably attached to one of the end panels. The mounting plate can include apertures through which the connecting material passes, and a mechanism, such as a buckle or clamp, for fixing the connecting material in place with respect to the mounting plate. The mounting plate can also include a mechanism for adjusting the position at which the mounting plate is removably attached to the end panel.

DETAILED DESCRIPTION OF THE INVENTION

Figure 1:
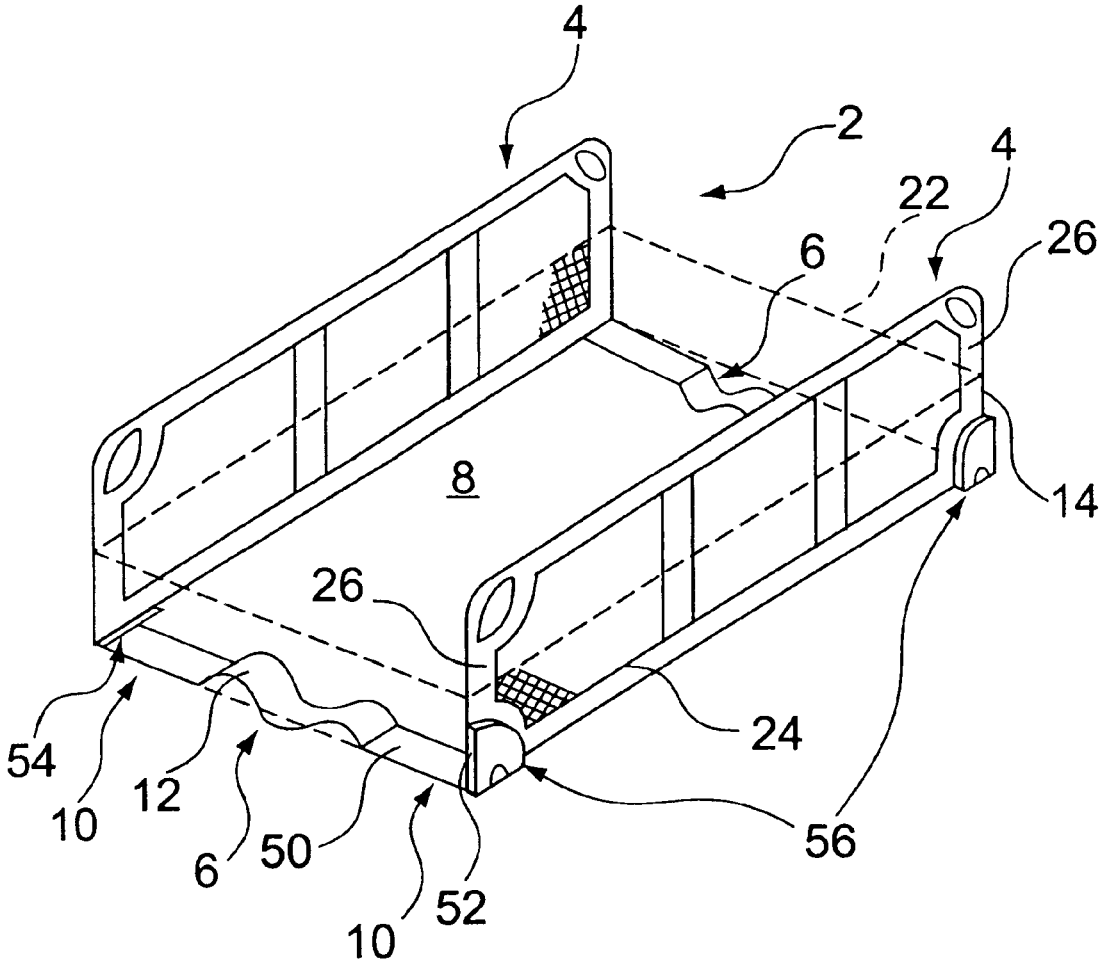
FIG. 1 is a diagram of a first exemplary embodiment of the present invention.

FIG. 1 shows a first exemplary embodiment of the bed guard assembly 2 of the present invention. This embodiment includes two end panels 4, flexible connecting material 6 for placement beneath a mattress 8, and connection pieces 10. As shown, the connection pieces 10 connect the flexible connecting material 6 to the end panels 4 such that at least one end panel opposes another end panel when the flexible connecting material 6 is disposed beneath a mattress 8. The flexible connecting material 6 can rest on a box spring located beneath the mattress 8, directly on the bed fame surface, on slats supporting the mattress 8, or on any other bedding element that might be present in the bedding configuration. Preferably, the end panels 4 extend vertically above the upper surface of the mattress 8.

The flexible connecting material 6 can include strips of webbing 12. As shown in FIG. 1, an exemplary embodiment includes two strips of webbing 12 material, connected to ends of the end panels 4. The strips of webbing 12 can be made of suitable material that is durable and flexible, such as nylon.

Figure 2:
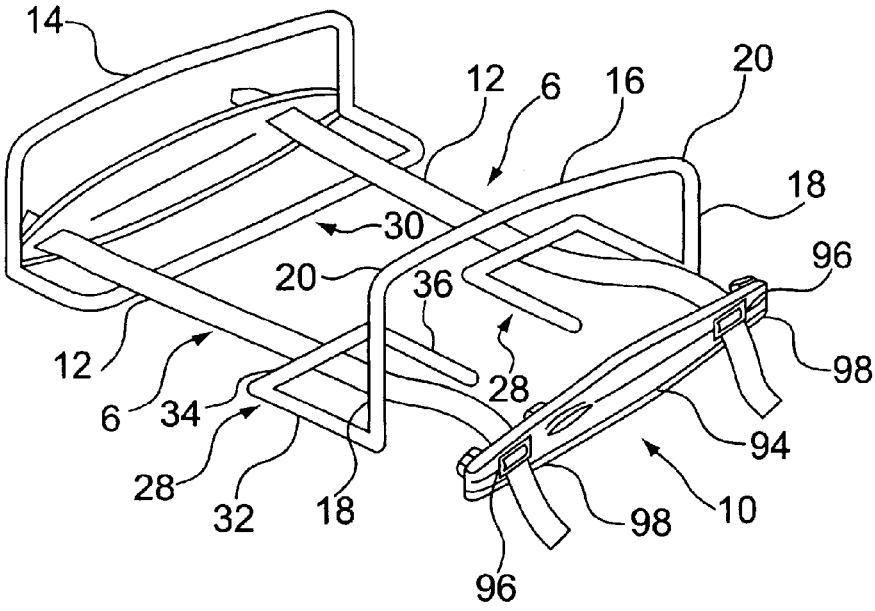
FIG. 2 is a diagram of a second exemplary embodiment of the present invention.

As shown, the exemplary end panels 4 include a rigid outer frame 14. This frame 14 can be made of any rigid, durable material. For example, the frame 14 can be constructed of hard plastic or PVC, or of metal, such as steel or aluminum. As shown in FIG. 2, the rigid outer frame 14 can be made from removably connected rigid tubes. These tubes can have ends with different cross-sectional diameters, so that each rigid tube can be fitted to adjacent rigid tubes by sliding the larger diameter end over a smaller diameter end. These tubes can be friction fitted for attachment, or can be fixed in place through the use of spring buttons or other fasteners.

The rigid outer frame 14 can be constructed as a unitary piece, or from a number of components, such as a top member 16, two side members 18, and two corner members 20 attaching respective side members 18 to opposite ends of the top member 16, as shown in FIG. 1. Alternatively, the rigid outer frame 14 can include substantially parallel opposing top and bottom portions 22, 24 connected to substantially parallel opposing side portions 26, and can have rounded corners at connections of the top piece with the side pieces, as shown in FIG. 1. In any case, the rigid outer frame 14 can include a number of segments 32, 34, 36 that are removably attached to each other, for easy disassembly and storage.

Figure 6:
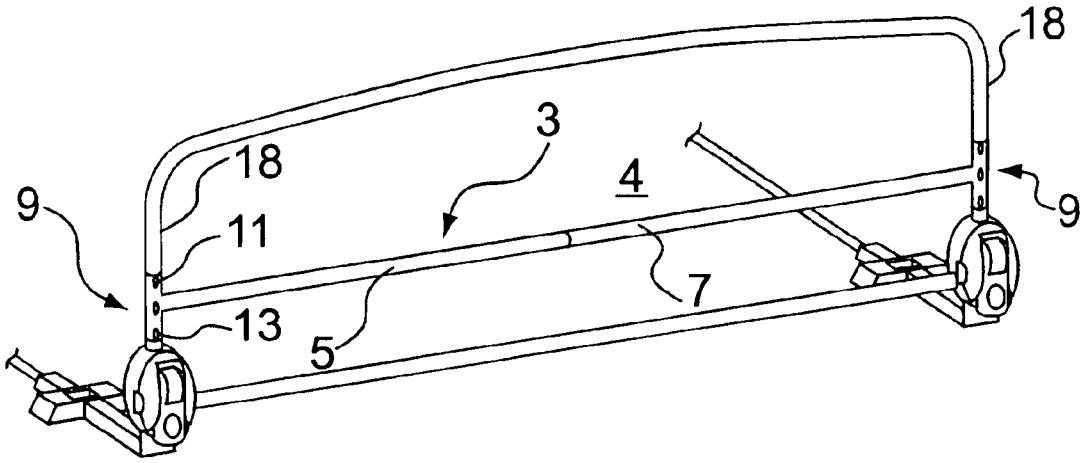
FIG. 6 is a diagram of an outer frame of an end panel having an additional horizontal segment.

As shown in FIG. 6, one or more end panels 4 can also include a horizontal segment 3, which can add stability to the panel, and can provide an added protective barrier. The horizontal segment 3 can be constructed, for example, of two or more slidably attached tubular segments 5, 7. As shown, the horizontal segment 3 can be coupled to the side members 18. In particular embodiments, the horizontal segment 3 will be slidably coupled to the side members 18. For example, the end portions 9 of the horizontal segment 3 can be tubes that slide over the respective side members 18.

Figure 7:
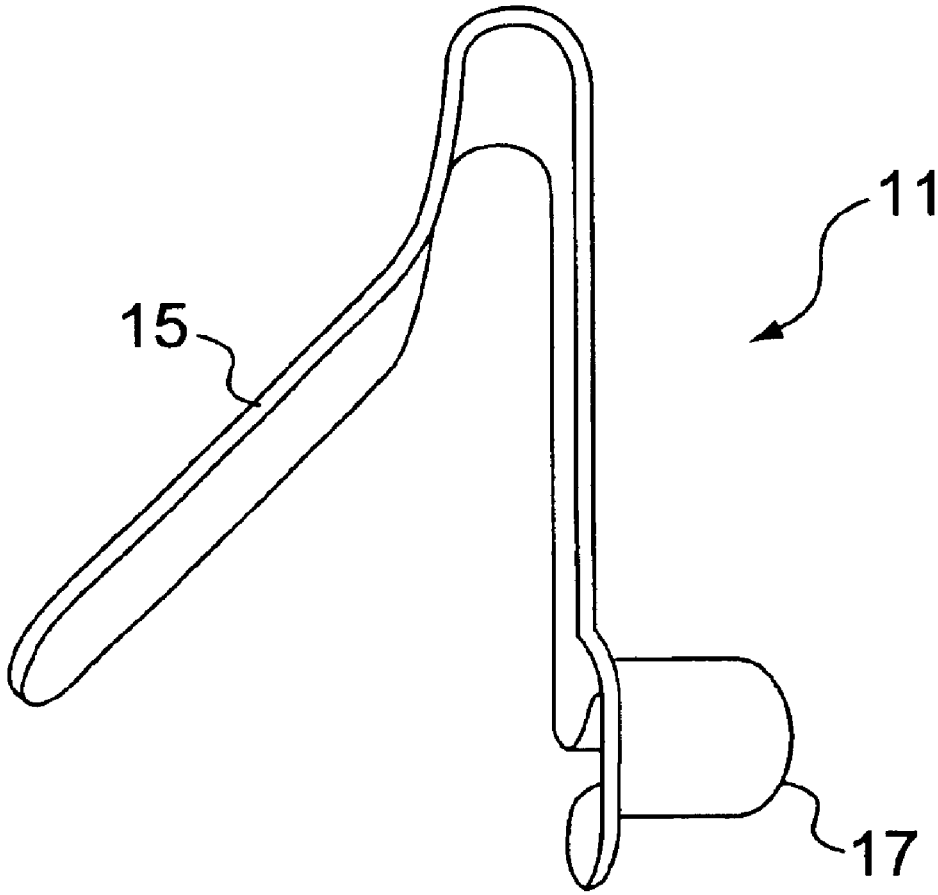
FIG. 7 shows an exemplary fastener.

With reference to FIG. 7, the bed guard assembly 2 can include fasteners 11 that fix the position of the horizontal segment 3 with respect to the side members 18. The height of the horizontal segment 3 can be made adjustable by providing a number of fasteners 11 on the side members 18, and selecting fasteners 11 corresponding to the desired height of the horizontal segment 3 to secure the attachment. These fasteners can be of a mating-pair type, for example, in which a first portion of the fastener is attached to the side members 18, and the second, mating portion is attached to the horizontal segment 3. Alternatively, fasteners on the side members 18 can mate with holes 13 in the ends of the horizontal segment 3 to fix the chosen position.

In a particular preferred embodiment, fasteners 11 are coupled to the insides of the side members 18. The side members 18 can include holes 13 through which the fasteners 11 can mate with holes 13 in the end portions 9 of the horizontal segment 3. If the end portions 9 of the horizontal segment 3 include a number of holes 13, as shown, the height of the horizontal segment 3 can be chosen by selecting the mating holes 13 accordingly. A fastener 11 that can be used advantageously with this embodiment includes a spring portion 15 and a button 17, as shown in FIG. 7. The spring portion 15 provides a bias that pushes the button 17 through the hole 13 in the side members 18 and through the selected hole 13 in the end portions 9 of the horizontal segment 3 to hold the horizontal segment 3 in place. Depressing the button 17 allows the horizontal segment 3 to be moved to a different position, where it can be fixed in place by releasing the button 17. An example of a commercial fastener of this type is a Valco® snap button.

The embodiment shown in FIG. 1 also has at least one extension 28, 30 that extends at a substantially right angle to a plane defined by the top portion 22 and the first and second side portions 26. For example, the frame 14 can include two extensions 28, one each attached to the first and second side portions 26, or a single extension 30 attached to the frame 14 at both side portions 26. Like the rest of the frame 14 shown in FIG. 2, each extension 28, 30 includes a number of connected segments 32, 34, 36. For example, the extensions 28 can each include three segments 32, 34, 36 that can be connected to form three sides of a rectangle, as shown, connected by one of the segments 32, 34, 36 to a side portion of the rigid outer frame 14 to form the extension 28. If there is only one extension 30, a second segment can be connected to the other side portion of the rigid outer frame 14. In any case, the extension(s) 28, 30 provide a base that allows the end panel to stand upright.

Figure 3:
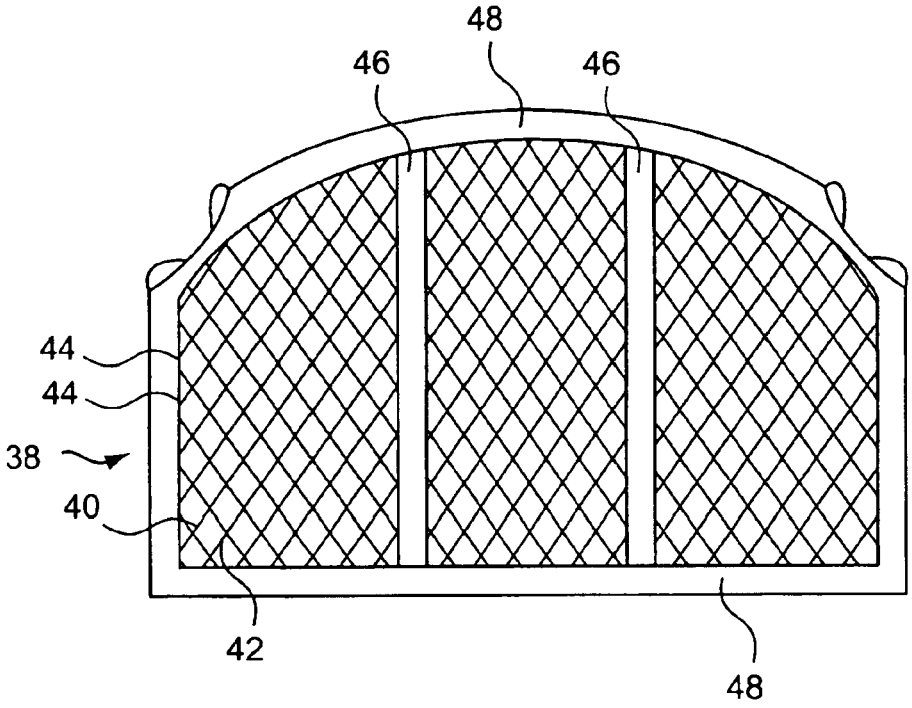
FIG. 3 is a diagram of an exemplary end panel of the present invention.

An exemplary end panel of the present invention is shown in FIG. 3. As shown in FIG. 1, the end panel includes a fabric portion 38 framed by the rigid outer frame 14. The fabric portion 38 can include netting 40, which in turn can be made from a mesh material 42 having openings 44 of any appropriate size, for example, between about 0.25 inches and about 2 inches. The fabric portion 38 can include one or more stabilizing straps 46 spanning the fabric portion 38, to provide more durability over the span of the fabric portion 38. The stabilizing straps 46 can be made of any flexible, strong material, such as nylon.

The fabric portion 38 can also include a border 48, which also can be made of nylon, around its outer periphery, and the stabilizing straps 46 can be attached to the netting 40 and to the nylon border 48, for example, at top and bottom ends of the fabric portion 38 as shown. Alternatively, the stabilizing straps 46 can be attached to the netting 40 and to top and bottom portions 22, 24 of the rigid outer frame 14 itself. The nylon border 48 can include a sleeve that accepts components of the rigid outer frame 14. For example, given the tubular construction of the frame 14 shown in FIG. 2, the individual top and side tubes can be inserted into the border sleeves and connected. Thus, when the frame 14 is complete, the fabric portion 38 is held in place by the border 48.

Another way that the fabric portion 38 can be removably attached to the rigid outer frame 14 is by fitting the fabric portion 38 over the rigid outer frame 14. In this case, the fabric portion 38 can be made from a stretch material that provides a tension fit with the rigid outer frame 14. Alternatively, the fabric portion 38 can be attached to the frame 14 through the use of fasteners, which attach to the frame 14 itself, or which attach to other fasteners on the fabric portion 38 after, for example, wrapping the frame 14. These fasteners can be, for example, snaps, or hook and loop fasteners such as Velcro®.

The connection pieces 10 preferably are rigid structures, constructed to form a substantially right angle 54 with the respective connected end panel The connection pieces 10 can be fixed to the end panels 4 and to the connecting material 6, or they can be removably attached. For example, the connection pieces 10 can be attached to the end panels 4 by a connection mechanism that provides the removable attachment. Alternatively, the connection pieces 10 can be simple articles, such as a rigid footing 50 attached to the connecting material 6.

Alternatively, the connection pieces 10 can be an angled joint 52 connected between the connecting material 6 and the end panels 4, preferably removably attached. The angled joint 52 can be adjustable, and can have a number of fixed stops. For example, the adjustable angled joint 52 can have a stop fixed at a substantially right angle 54, and other stops to fix the relative position at other useful angles. The range of adjustability of the angled joint 52 preferably allows the end that is attached to the connecting material 6 to be folded against the end panel, providing a low profile for storage.

Figure 4:
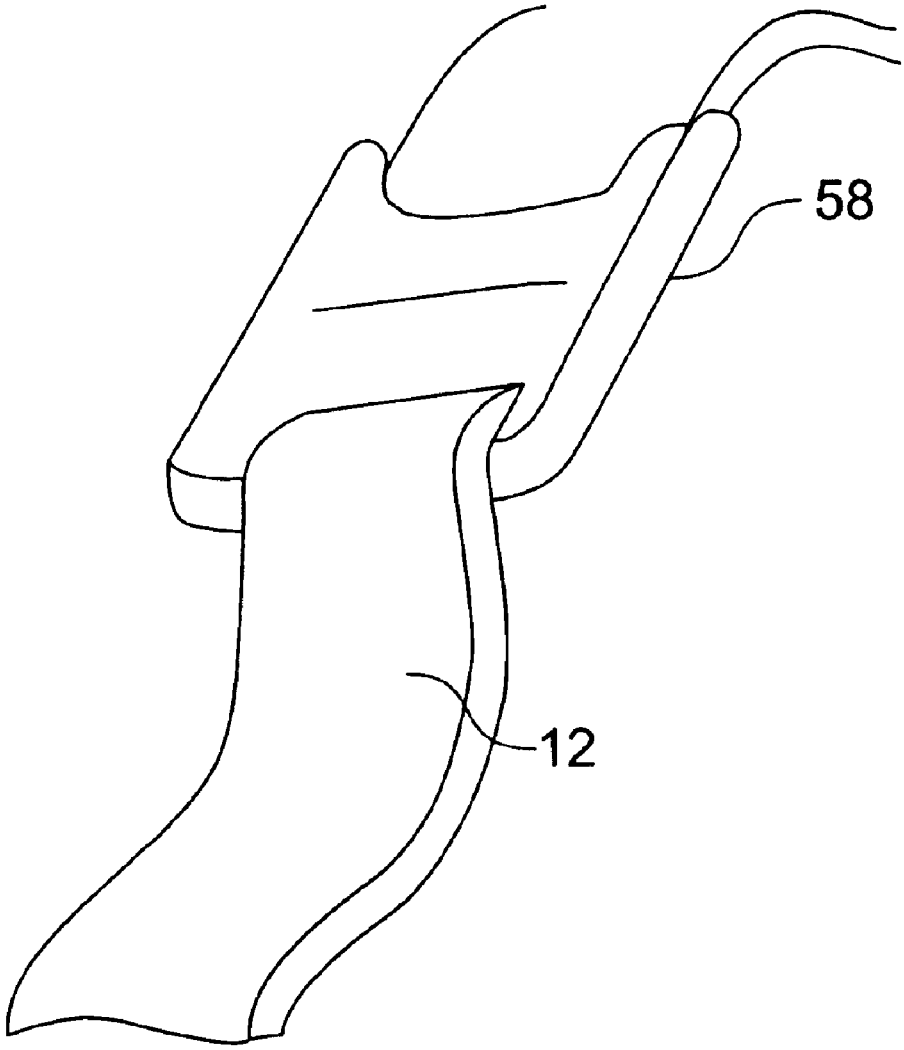
FIG. 4 is a diagram of a first exemplary adjustment mechanism of the present invention.

The connection pieces 10 can also include an adjustment mechanism, such as a mechanism for decreasing the length of connecting material 6 disposed between the end panels 4, or for reducing an amount of slack of connecting material 6 disposed between the end panels 4 when the end panels 4 are disposed in fixed positions or when the connecting material 6 is disposed beneath the mattress 8 and the end panels 4 are placed against opposite sides of the mattress 8. For example, the mechanism 56 can be a buckle 58 or similar device that is well known to those of skill in the art. An example of such a buckle 58 is shown in FIG. 4.

Figure 5A:
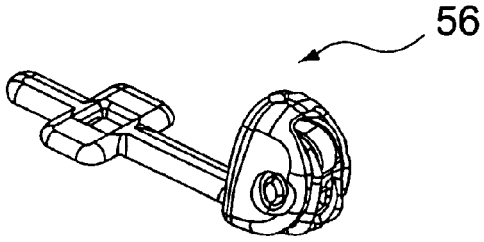
FIG. 5A is a diagram of a second exemplary ratcheting adjustment mechanism of the present invention.
Figure 5B:
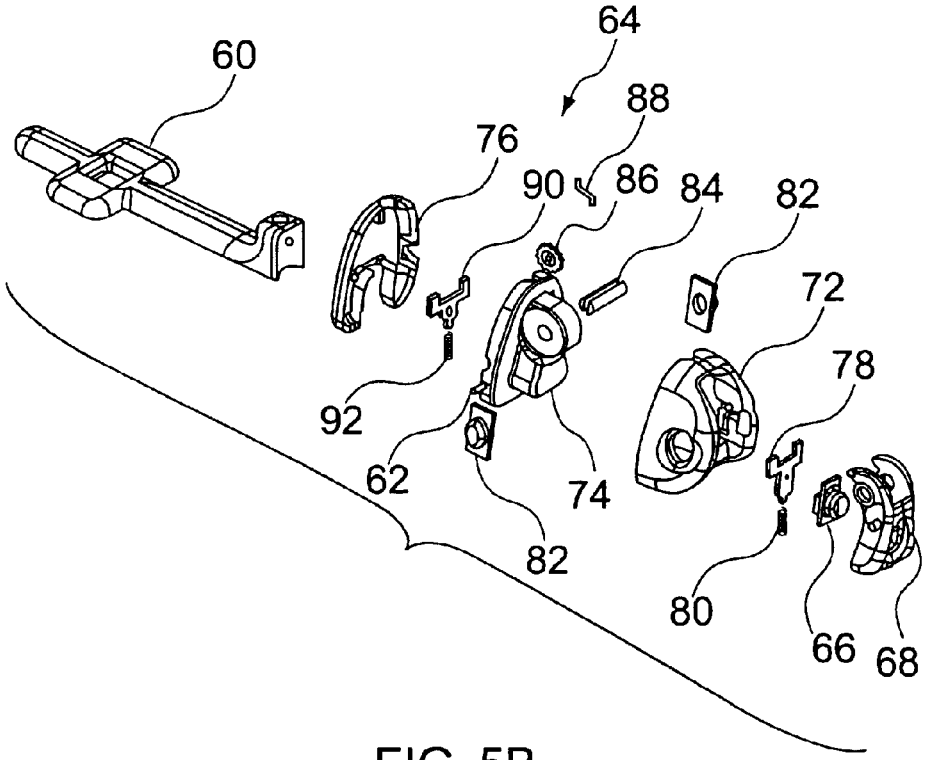
FIG. 5B is an exploded view of the second exemplary adjustment mechanism of the present invention.

Alternatively, a more complicated mechanism can be utilized, such as the one shown in FIGS. 5A and 5B. The mechanism 56 includes a foot 60 as a base. The mechanism 56 also includes a strap tensioner 62 in communication with the connecting material 6, which provides releasable attachment of the mechanism 56 with the connection material. The strap tensioner 62 can be a clamp or other element that grips the connecting material 6 by way of friction or grasping implements. The mechanism 56 can further include a ratchet device 64 in communication with the strap tensioner 62, to control travel of the connecting material 6 with respect to the mechanism 56. That is, the ratchet device 64 controls the direction and extent of travel of the gripped connecting material 6, in a manner known to those of skill in the art. A trigger device 66 with a handle 68 is also included, to actuate the ratchet device 64 to initiate travel of the connecting material 6.

The mechanism 56 includes a housing 70, including a shroud 72, shroud back 74, and back mounting plate 76, attached to the foot 60 and to the end panel. The shroud 72 houses a handle trigger 78 and trigger spring 80 for the trigger device 66, as well as a pair of housing triggers 82. The shroud back 74 provides a base for the strap tensioner 62 and elements of the ratchet device 64, such as the spindle 84, take up gear 86, and spindle pin 88. The shroud back 74 and back mounting plate 76 together house the shroud trigger 90 and trigger spring 92.

As an alternative, the connection pieces 10 can include a mounting plate 94 that is removably attached to one of the end panels 4, as shown in FIG. 2, such as by attachment to the end pieces of the frame 14. The mounting plate 94 can include apertures 96 through which the connecting material 6 passes, and a mechanism 98, such as a buckle or clamp, for fixing the connecting material 6 in place with respect to the mounting plate 94. The height of the mounting plate 94 with respect to the frame 14 can be fixed by selecting the point at which the mounting plate 94 is attached to the end pieces. Alternatively, the mounting plate 94 can include a mechanism for adjusting the position at which the mounting plate 94 is removably attached to the end panel.

Alternative embodiments are contemplated in which the bed guard assembly has only one end panel. In this case, the other end panel will be replaced by an implement that grasps the mattress on that side, or that otherwise provides a stationary base that allows the connecting material to be pulled taut at the end panel on the opposing side. In this one-sided embodiment, it is contemplated that the connecting material can be rigid, rather than flexible.

Particular exemplary embodiments of the present invention have been described in detail. These exemplary embodiments are illustrative of the inventive concept recited in the appended claims, and are not limiting of the scope or spirit of the present invention as contemplated by the inventors.

What is claimed is:

1. A bed guard assembly, comprising:

a plurality of end panels;

flexible connecting material for placement beneath a mattress; and connection pieces that connect the flexible connecting material to the end panels such that at least one end panel of the plurality of end panels opposes another end panel of the plurality of end panels when the flexible connecting material is disposed beneath a mattress;

wherein the end panels include a rigid outer frame and a substantially horizontal rigid segment spanning an interior of the outer frame; and wherein the flexible connecting material includes strips of webbing.

2. The assembly of claim 1, wherein the rigid outer frame is made from removably connected rigid tubes.

3. The assembly of claim 1, wherein the substantially horizontal rigid segment includes a plurality of removably connected rigid tubes.

4. The assembly of claim 1, wherein the plurality of end panels are two end panels.

5. The assembly of claim 1, wherein the strips of webbing include a first strip of webbing connected to first ends of the end panels, and a second strip of webbing connected to second ends of the end panels.

6. The assembly of claim 1, wherein the strips of webbing are made of a material including nylon.

7. The assembly of claim 1, wherein the rigid outer frame is metal.

8. The assembly of claim 1, wherein the rigid outer frame is steel.

9. The assembly of claim 1, wherein the rigid outer frame includes a number of segments that are removably attached to each other.

10. The assembly of claim 1, wherein the connection pieces are rigid structures, and each said connection piece forms a substantially right angle with the respective connected end panel.

11. The assembly of claim 10, wherein the connection pieces are removably attached to the end panels and to the connecting material.

12. The assembly of claim 11, wherein the connection pieces are attached to the end panels by a connection mechanism.

13. The assembly of claim 12, wherein each said connection piece includes a rigid footing attached to the connecting material.

14. The assembly of claim 1, wherein the connection pieces include a mounting plate that is removably attached to one of the end panels.

15. A bed guard assembly, comprising:

a plurality of end panels;

flexible connecting material for placement beneath a mattress; and connection pieces that connect the flexible connecting material to the end panels such that at least one end panel of the plurality of end panels opposes another end panel of the plurality of end panels when the flexible connecting material is disposed beneath a mattress;

wherein the end panels include a rigid outer frame and a substantially horizontal rigid segment spanning an interior of the outer frame;

wherein the rigid outer frame includes substantially parallel opposing top and bottom portions connected to substantially parallel opposing side portions;

wherein the substantially horizontal rigid segment is coupled to the substantially parallel opposing side portions; and wherein the assembly further comprises fasteners that fix a position of the substantially horizontal rigid segment with respect to the substantially parallel opposing side portions.

16. The assembly of claim 15, wherein the substantially horizontal rigid segment is slidably coupled to the substantially parallel opposing side portions.

17. A bed guard assembly, comprising:

a plurality of end panels;

flexible connecting material for placement beneath a mattress; and connection pieces that connect the flexible connecting material to the end panels such that at least one end panel of the plurality of end panels opposes another end panel of the plurality of end panels when the flexible connecting material is disposed beneath a mattress;

wherein the end panels include a rigid outer frame and a substantially horizontal rigid segment spanning an interior of the outer frame;

wherein the rigid outer frame includes substantially parallel opposing top and bottom portions connected to substantially parallel opposing side portions;

wherein the substantially horizontal rigid segment is coupled to the substantially parallel opposing side portions; and wherein the assembly further comprises a plurality of fasteners, selected ones of which fix the substantially horizontal rigid segment at a selected position with respect to the substantially parallel opposing side portions, corresponding to the selected ones of the fasteners.

18. A bed guard assembly, comprising:

a plurality of end panels;

flexible connecting material for placement beneath a mattress; and connection pieces that connect the flexible connecting material to the end panels such that at least one end panel of the plurality of end panels opposes another end panel of the plurality of end panels when the flexible connecting material is disposed beneath a mattress;

wherein the end panels include a rigid outer frame and a substantially horizontal rigid segment spanning an interior of the outer frame;

wherein the rigid outer frame includes substantially parallel opposing top and bottom portions connected to substantially parallel opposing side portions; and wherein the assembly further comprises:

first fastener portions coupled to the substantially parallel opposing side portions; and second fastener portions, coupled to the substantially horizontal rigid segment, which mate with corresponding ones of the first fastener portions to fix a position of the substantially horizontal rigid segment with respect to the substantially parallel opposing side portions.

19. A bed guard assembly, comprising:

a plurality of end panels;

flexible connecting material for placement beneath a mattress; and connection pieces that connect the flexible connecting material to the end panels such that at least one end panel of the plurality of end panels opposes another end panel of the plurality of end panels when the flexible connecting material is disposed beneath a mattress;

wherein the end panels include a rigid outer frame and a substantially horizontal rigid segment spanning an interior of the outer frame;

wherein the rigid outer frame includes substantially parallel opposing top and bottom portions connected to substantially parallel opposing side portions;

wherein the substantially horizontal rigid segment is coupled to the substantially parallel opposing side portions;

wherein the assembly further comprises fasteners coupled to the substantially parallel opposing side portions; and wherein the substantially horizontal rigid segment includes apertures that mate with corresponding ones of the fasteners to fix a position of the substantially horizontal rigid segment with respect to the substantially parallel opposing side portions.

20. A bed guard assembly, comprising:

a plurality of end panels;

flexible connecting material for placement beneath a mattress; and connection pieces that connect the flexible connecting material to the end panels such that at least one end panel of the plurality of end panels opposes another end panel of the plurality of end panels when the flexible connecting material is disposed beneath a mattress;

wherein the end panels include a rigid outer frame and a substantially horizontal rigid segment spanning an interior of the outer frame;

wherein the rigid outer frame includes substantially parallel opposing top and bottom portions connected to substantially parallel opposing side portions;

wherein the substantially horizontal rigid segment is coupled to the substantially parallel opposing side portions;

wherein the substantially horizontal rigid segment includes a tubular horizontal portion having first and second end portions that couple with the substantially parallel opposing side portions; and wherein the tubular horizontal portion includes a plurality of slidably attached tubular segments.

21. A bed guard assembly, comprising:

a plurality of end panels;

flexible connecting material for placement beneath a mattress; and connection pieces that connect the flexible connecting material to the end panels such that at least one end panel of the plurality of end panels opposes another end panel of the plurality of end panels when the flexible connecting material is disposed beneath a mattress;

wherein the end panels include a rigid outer frame and a substantially horizontal rigid segment spanning an interior of the outer frame;

wherein the rigid outer frame includes substantially parallel opposing top and bottom portions connected to substantially parallel opposing side portions;

wherein the substantially horizontal rigid segment is coupled to the substantially parallel opposing side portions;

wherein the substantially horizontal rigid segment includes a tubular horizontal portion having first and second end portions that couple with the substantially parallel opposing side portions; and wherein the first and second end portions are substantially vertically-oriented tubes that slide over the respective substantially parallel opposing side portions.

22. A bed guard assembly, comprising:

a plurality of end panels;

flexible connecting material for placement beneath a mattress; and connection pieces that connect the flexible connecting material to the end panels such that at least one end panel of the plurality of end panels opposes another end panel of the plurality of end panels when the flexible connecting material is disposed beneath a mattress;

wherein the end panels include a rigid outer frame and a substantially horizontal rigid segment spanning an interior of the outer frame;

wherein the rigid outer frame includes substantially parallel opposing top and bottom portions connected to substantially parallel opposing side portions;

wherein the substantially horizontal rigid segment is coupled to the substantially parallel opposing side portions;

wherein the substantially horizontal rigid segment includes a tubular horizontal portion having first and second end portions that couple with the substantially parallel opposing side portions;

wherein the assembly further comprises fasteners coupled to the substantially parallel opposing side portions; and wherein the first and second end portions include apertures that communicate with the fasteners to fix a position of the substantially horizontal rigid segment with respect to the substantially parallel opposing side portions.

23. The assembly of claim 22, wherein the substantially parallel opposing side portions include apertures through which the fasteners communicate with the apertures in the first and second end portions.

24. The assembly of claim 23, wherein each said fastener includes a spring portion and a button, wherein the spring portion provides a bias that pushes the button through a respective one of the apertures in the substantially parallel opposing side portions and a respective one of the apertures in the first and second end portions to fix a position of the substantially horizontal rigid segment with respect to the substantially parallel opposing side portions.

25. A bed guard assembly, comprising:

a plurality of end panels;

flexible connecting material for placement beneath a mattress; and connection pieces that connect the flexible connecting material to the end panels such that at least one end panel of the plurality of end panels opposes another end panel of the plurality of end panels when the flexible connecting material is disposed beneath a mattress;

wherein the end panels include a rigid outer frame and a substantially horizontal rigid segment spanning an interior of the outer frame; and wherein the rigid outer frame includes a top portion and first and second side portions, and at least one extension that extends at a substantially right angle to a plane defined by the top portion and the first and second side portions.

26. A bed guard assembly, comprising:

a plurality of end panels;

flexible connecting material for placement beneath a mattress; and connection pieces that connect the flexible connecting material to the end panels such that at least one end panel of the plurality of end panels opposes another end panel of the plurality of end panels when the flexible connecting material is disposed beneath a mattress;

wherein the end panels include a rigid outer frame and a substantially horizontal rigid segment spanning an interior of the outer frame;

wherein the rigid outer frame includes substantially parallel opposing top and bottom portions connected to substantially parallel opposing side portions;

wherein the substantially horizontal rigid segment is coupled to the substantially parallel opposing side portions;

wherein the substantially horizontal rigid segment includes a tubular horizontal portion having first and second end portions that couple with the substantially parallel opposing side portions;

wherein the assembly further comprises fasteners coupled to the substantially parallel opposing side portions; and wherein the first and second end portions include a plurality of apertures, including selected ones that communicate with the fasteners to fix the substantially horizontal rigid segment at a position with respect to the substantially parallel opposing side portions corresponding to the selected ones of the plurality of apertures.

27. The assembly of claim 25, wherein the at least one extension provides a base that allows the respective end panel to stand upright.

28. The assembly of claim 25, wherein the rigid outer frame is made from removably connected rigid tubes.

29. The assembly of claim 25, wherein the substantially horizontal rigid segment includes a plurality of removably connected rigid tubes.

30. The assembly of claim 25, wherein the plurality of end panels are two end panels.

31. The assembly of claim 25, wherein the rigid outer frame is metal.

32. The assembly of claim 25, wherein the rigid outer frame is steel.

33. The assembly of claim 25, wherein the rigid outer frame includes a number of segments that are removably attached to each other.

34. The assembly of claim 25, wherein the connection pieces are rigid structures, and each said connection piece forms a substantially right angle with the respective connected end panel.

35. The assembly of claim 34, wherein the connection pieces are removably attached to the end panels and to the connecting material.

36. The assembly of claim 35 wherein the connection pieces are attached to the end panels by a connection mechanism.

37. The assembly of claim 36, wherein each said connection piece includes a rigid footing attached to the connecting material.

38. The assembly of claim 25, wherein each said connection piece includes a first end connected to the connecting material and a second end connected to the end panels, and an angled joint between the first and second ends.

39. The assembly of claim 38, wherein the first end is removably attached to the connecting material and the second end is removably attached to the end panels.

40. The assembly of claim 25, wherein the connection pieces include a mechanism for decreasing the length of connecting material disposed between the end panels.

41. The assembly of claim 40, wherein the mechanism is a buckle.

42. The assembly of claim 25, wherein the connection pieces include a mechanism for reducing an amount of slack of connecting material disposed between the end panels when the end panels are disposed in fixed positions.

43. The assembly of claim 42, wherein the mechanism is a buckle.

44. The assembly of claim 25, wherein the connection pieces include a mechanism for reducing an amount of slack of connecting material disposed between the end panels when the connecting material is disposed beneath the mattress and the end panels are placed against opposite sides of the mattress.

45. The assembly of claim 44, wherein the mechanism is a buckle.

46. The assembly of claim 45, wherein the mechanism includes a strap tensioner in communication with the connecting material, which provides releasable attachment of the mechanism with the connection material.

47. The assembly of claim 46, wherein the mechanism further includes a ratchet device in communication with the strap tensioner, which controls travel of the connecting material with respect to the mechanism.

48. The assembly of claim 25, wherein the connection pieces include a mounting plate that is removably attached to one of the end panels.

49. A bed guard assembly, comprising:

a plurality of end panels;

flexible connecting material for placement beneath a mattress; and connection pieces that connect the flexible connecting material to the end panels such that at least one end panel of the plurality of end panels opposes another end panel of the plurality of end panels when the flexible connecting material is disposed beneath a mattress;

wherein the end panels include a rigid outer frame and a substantially horizontal rigid segment spanning an interior of the outer frame;

wherein the end panel includes a fabric portion framed by the rigid outer frame.

50. The assembly of claim 49, wherein the fabric portion includes netting.

51. The assembly of claim 50, wherein the fabric portion includes a nylon border on an outer periphery.

52. The assembly of claim 51, wherein the nylon border includes a sleeve that accepts components of the rigid outer frame.

53. The assembly of claim 49, wherein the fabric portion is removably attached to the rigid outer frame.

54. The assembly of claim 53, wherein the fabric portion is fitted over the rigid outer frame.

55. The assembly of claim 54, wherein the fabric portion is fitted over the substantially horizontal rigid segment.

56. The assembly of claim 54, wherein the fabric portion includes a stretch material that provides a tension fit with the rigid outer frame.

57. A bed guard assembly, comprising:

a plurality of end panels;

flexible connecting material for placement beneath a mattress; and connection pieces that connect the flexible connecting material to the end panels such that at least one end panel of the plurality of end panels opposes another end panel of the plurality of end panels when the flexible connecting material is disposed beneath a mattress;

wherein the end panels include a rigid outer frame and a substantially horizontal rigid segment spanning an interior of the outer frame;

wherein each said connection piece includes a first end connected to the connecting material and a second end connected to the end panels, and an angled joint between the first and second ends; and wherein the first end is removably attached to the connecting material and the second end is removably attached to the end panels.

58. A bed guard assembly, comprising:

a plurality of end panels;

flexible connecting material for placement beneath a mattress; and connection pieces that connect the flexible connecting material to the end panels such that at least one end panel of the plurality of end panels opposes another end panel of the plurality of end panels when the flexible connecting material is disposed beneath a mattress;

wherein the end panels include a rigid outer frame and a substantially horizontal rigid segment spanning an interior of the outer frame;

wherein the connection pieces include a mechanism for decreasing the length of connecting material disposed between the end panels; and wherein the mechanism is a buckle.

59. A bed guard assembly, comprising:

a plurality of end panels;

flexible connecting material for placement beneath a mattress; and connection pieces that connect the flexible connecting material to the end panels such that at least one end panel of the plurality of end panels opposes another end panel of the plurality of end panels when the flexible connecting material is disposed beneath a mattress;

wherein the end panels include a rigid outer frame and a substantially horizontal rigid segment spanning an interior of the outer frame;

wherein the connection pieces include a mechanism for reducing an amount of slack of connecting material disposed between the end panels when the end panels are disposed in fixed positions; and wherein the mechanism is a buckle.

60. A bed guard assembly, comprising:

a plurality of end panels;

flexible connecting material for placement beneath a mattress; and connection pieces that connect the flexible connecting material to the end panels such that at least one end panel of the plurality of end panels opposes another end panel of the plurality of end panels when the flexible connecting material is disposed beneath a mattres;

wherein the end panels include a raid outer frame and a substantially horizontal rigid segment spanning an interior of the outer frame;

wherein the connection pieces include a mechanism for reducing an amount of slack of connecting material disposed between the end panels when the connecting material is disposed beneath the mattress and the end panels are placed against opposite sides of the mattress; and wherein the mechanism is a buckle.

61. The assembly of claim 60, wherein the mechanism includes a strap tensioner in communication with the connecting material, which provides releasable attachment of the mechanism with the connection material.

62. The assembly of claim 61, wherein the mechanism further includes a ratchet device in communication with the strap tensioner, which controls travel of the connecting material with respect to the mechanism.

* * * * *